United States Patent [19]

Harayama

[11] Patent Number: 4,896,664

[45] Date of Patent: Jan. 30, 1990

[54] SNORKEL

[75] Inventor: Chiharu Harayama, Atsugi, Japan

[73] Assignee: Junkosha Co., Ltd., Tokyo, Japan

[21] Appl. No.: 333,522

[22] Filed: Apr. 4, 1989

[30] Foreign Application Priority Data

Apr. 7, 1988 [JP] Japan ..... 63-47063

[51] Int. Cl.[4] ..... A62B 7/00

[52] U.S. Cl. ..... 128/200.25; 128/201.11

[58] Field of Search ..... 128/200.25, 201.11, 128/201.25; 264/288.8

[56] References Cited

U.S. PATENT DOCUMENTS

| | | | |
|---|---|---|---|
| 3,318,306 | 5/1967 | Strauss | 128/200.25 |
| 3,333,583 | 8/1967 | Bodell | 128/200.25 |
| 3,369,343 | 2/1968 | Robb | 128/200.25 |
| 3,953,566 | 4/1976 | Gore | 264/289.3 |
| 3,962,153 | 6/1976 | Gore | 264/290.2 |
| 4,082,893 | 4/1978 | Okita | 264/288.8 |
| 4,096,227 | 6/1978 | Gore | 264/288.8 |
| 4,187,390 | 2/1980 | Gore | 264/288.8 |
| 4,344,427 | 8/1982 | Marvin | 128/200.25 |
| 4,482,516 | 11/1984 | Bowman et al. | 264/288.8 |
| 4,605,000 | 8/1986 | Anguita | 128/201.25 |

*Primary Examiner*—Eugene H. Eickholt

*Attorney, Agent, or Firm*—Gary A. Samuels

[57] ABSTRACT

A snorkel device for breathing under the surface of water which will allow both inhaling and exhaling of air underwater. A multiplicity of water impermeable tubes, permeable to dissolved or gaseous oxygen, allow underwater passage of oxygen into the snorkel. Preferred tube material is porous expanded polytetrafluoroethylene.

6 Claims, 2 Drawing Sheets

SNORKEL

FIELD OF THE INVENTION

This invention pertains to snorkel devices for breathing under the surface of water, in particular to a device which will allow both inhaling and exhaling of breath both above and below the surface of the water.

BACKGROUND OF THE INVENTION

Conventional snorkels which are widely used as diving accessories consist of a mouthpiece and a breathing tube which connects with the mouthpiece. The breathing tube is fastened to the side of underwater goggles or facemasks which are worn on the head. However, depending on the intended use and the degree of skill in said use, various other parts may be added to the above basic construction and many variations in shape or contour are possible. However, such variations involve almost no change in the function of the apparatus. A user inserts the flange portion of the mouthpiece in his mouth and holds the projections of the flange in his teeth. The user then breathes through the breathing opening. The breathing tube is a bent tube formed from soft rubber which is fastened to the mouthpiece and a straight length of tubing extending the bent portion of the tube to above water level. An exhaust portion of the mouthpiece is equipped with an exhaust valve, usually made of rubber and formed in the shape of a thin round dish. The exhaust valve is kept closed by the external water pressure and acts as a check valve which allows the expulsion of breath when the edge portion is opened by the pressure of breath from the inside of the breathing opening. Part of the exhaled breath is also expelled via the breathing tube.

The simplest types of snorkels are not equipped with the exhaust portion of the mouthpiece or the exhaust valve. Accordingly, in this type of snorkel breathing is accomplished exclusively via the bent tube and breathing tube. Thus, during breathing, breath remaining in the bent tube and breathing tube as a result of previous exhalation is re-inhaled.

In such conventional snorkels, breathing can only be accomplished when the upper end of the breathing tube is projecting above water level, which results in a limit to the depth to which the user's head can be submerged. If water enters the breathing tube during use as a result of carelessness or wave action, skill is required in the technique used to expel this water outside of the tube using breath pressure. An inexperienced user may therefore be in danger.

SUMMARY OF THE INVENTION

The present invention is a snorkel comprising a mouthpiece, including an exhaust valve for exhaling breathed air. A bent breathing tube attached to the mouthpiece and an air-absorbing construction, in which the open ends of a multiplicity of porous drawn or expanded polymer tubes which are closed at one end, are gathered into a honeycomb-form unitary portion, which is sealed to the open end of the breathing tube. Thus, water does not enter the breathing tube even when the entire snorkel is completely submerged beneath the surface of the water. Accordingly, there is no danger that the user will inhale water as in the case of conventional snorkels, since the walls of the drawn or expanded polymer tubes are formed from a hydrophobic polymer having fine continuous pores. At water pressures at which use of a snorkel is possible, gases will permeate the hydrophobic porous tube walls, but water will not.

Gases, primarily oxygen dissolved in the water, will enter the porous tubes during diving and the user obtains conditions which are close to the breathing of air above the surface of the water. The amount of oxygen which enters via a given unit area of the porous tubes is extremely small, but the total surface area of the multiplicity of tubes is extremely large and the tubes can be used as an underwater air-absorbing body while the snorkel is underwater.

DESCRIPTION OF THE PREFERRED EMBODIMENTS

Figure 1:
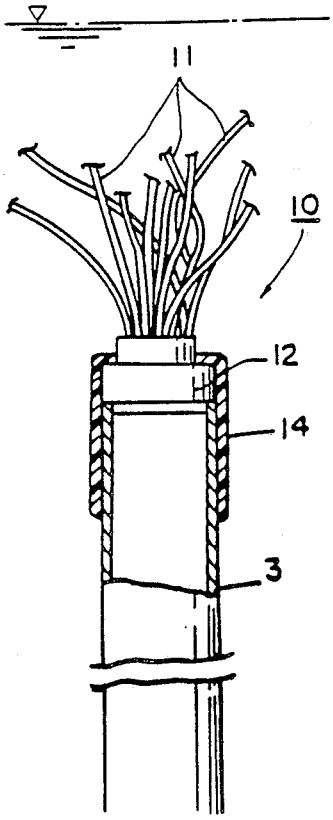
FIG. 1 shows a partial cross-section of an end of a snorkel tube fitted with a cap holding the porous drawn polymer tubes of the invention.
Figure 2:
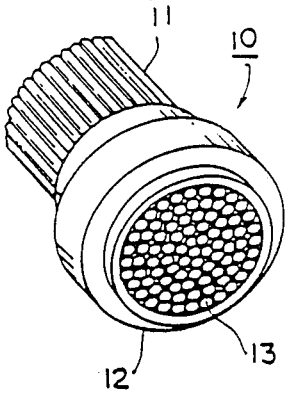
FIG. 2 describes the gathered open tube ends in a fitting for attachment to a breathing tube.
Figure 3:
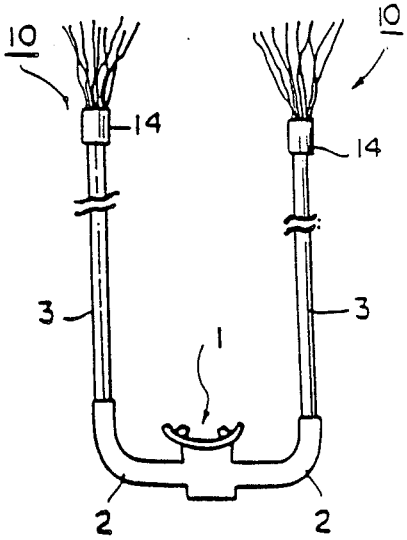
FIG. 3 discloses a snorkel with porous tubes attached to the breathing tubes.
Figure 4:
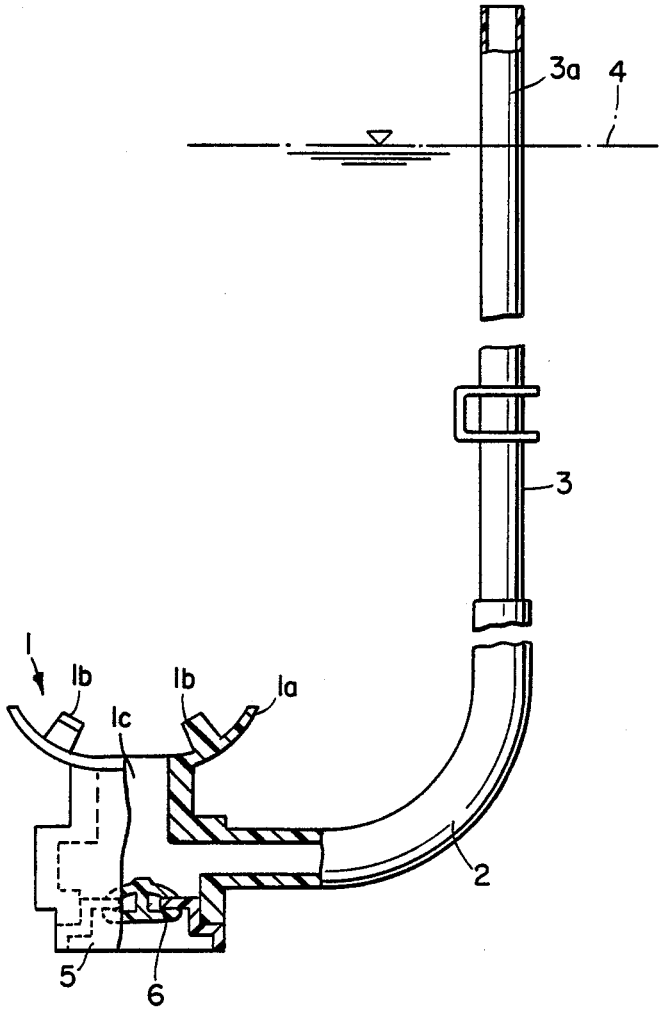
FIG. 4 describes a partial cross-section of the mouthpiece portion of the snorkel and the attached bent and straight breathing tubes.

Referring now to the figures to more closely define and describe the invention, FIG. 1 shows a breathing tube 3 on which is fitted a connecting tube 14 in which a plastic sleeve 12 is fitted over the bundled open ends of the multiplicity of porous drawn or expanded hydrophobic polymeric tubes 11 which are closed at their opposite ends. FIG. 2 describes the honeycomb like structure 13 of the underwater air-absorbing body 10, including plastic sleeve 12 and porous tubes 11. FIG. 3 shows two air-absorbing bodies 10 fitted onto breathing tubes 3, which fit into curved tubes 2 which form extended portions of the mouthpiece 1 of the snorkel. In FIG. 4 the partial cross-sectioned portion of the mouthpiece 1 shows the exhaust portion 5 of mouthpiece 1 and flexible exhaust valve 6 which is formed in the shape of a thin round disk which acts as a check valve.

A user of the snorkel inserts the flange part 1*a* of the mouthpiece 1 in his mouth and holds projection 1*b* in his teeth, then breathes through the breathing opening 1*c*. Bent tube 2 is formed from soft rubber or the like and is an extension of or fastened to the mouthpiece 1. Breathing tube 3 is inserted into bent tube 2. Exhaust part 5 is equipped with an exhaust valve 6 which is kept closed by the external water pressure, and acts as a check valve which allows the expulsion of breath when the edge portion is opened by the pressure of breath from the inside of the breathing opening 1*c*. Some exhaled breath is also expelled via the breathing tube 3.

The simplest types of snorkel are not equipped with exhaust part 5 or exhaust valve 6 and, in this type of snorkel, breathing is accomplished exclusively via bent tube 2 and breathing tube 3. As a result, during breathing, breath remaining in the bent tube 2 and breathing tube 3 as a result of previous exhalation is re-inhaled. In this snorkel, breathing can only be accomplished when the upper end 3*a* of breathing tube 3 is projecting above the water level 4. This results in limitation of the depth to which the user's head can be submerged. If water should enter the breathing tube during use, skill is required in the technique used to expel this water to the outside of the tube using breath pressure.

In the snorkel of the invention, the walls of tubes 11 are preferably made of drawn or expanded polytetrafluoroethylene (PTFE) which are continuously porous as a result of the drawing of the PTFE as described in U.S. Pat. Nos. 3,953,566, 4,187,390, 4,096,227, 3,962,153, and 4,482,516 for example. The tubes have varying physical properties depending on the drawing conditions and drawing techniques used and the result is tough, flexible tube walls which have a fine fibrous structure and continuous pores over their entire surface. The tensile strength of said tubes exceeds 700 kg/cm$^2$.

The drawn PTFE tubes are intrinsically hydrophobic and are therefore not wetted by water. As long as there is no treatment with or presence of a surfactant, the osmotic pressure for water is large, so that water tends not to permeate the tube walls into the interior of the tubes, even if the tubes are submerged in water. However, gases in the water, such as oxygen, pass through the tube walls into the interior of the tubes.

Accordingly, in the case of tubes 11 used in this practical example of application, appropriate setting of the pore size and porosity [porosity=(pore volume/total volume)×100] of the tube walls in accordance with the intended use of the snorkel produces tubes which are waterproof, but which have a good permeability with respect to gases, especially oxygen, dissolved in the water. Since the total surface area of the large number of tubes 11 used is extremely large, a considerable amount of oxygen permeates into the tubes as a whole, even though the amount of solute oxygen which passes through the pores of a given unit length of tubing is extremely small. Of the total amount of air which is inhaled using a conventional snorkel, about 20% is oxygen, which supports human respiration. In the case of the present practical example of the application, almost all of the gas that is inhaled is oxygen. Although there are of course limits, diving for a relatively long period of time at a water depth suited to the characteristics of tubes 11 is possible. Furthermore, since water does not enter tubes 11, the danger to an inexperienced user encountered in the case of conventional snorkels is considerably reduced. Furthermore, since tubes 11 are flexible, and have a large elongation and a high tensile strength, any entanglement of the floating tubes 11 with debris in the water will be noted by the user before breakage of the tubes occurs and thus the danger of tube breakage is avoided. Tubes 11 are gathered into a bundle a plastic sleeve 12 is fitted over the bundled ends, and the ends adhered together by heat-fusing or bonding with an adhesive to form a honeycomb-like end 13. Sleeve 12 holding end 13 is fitted onto the open end of tube 3 in an airtight manner.

The porous tubes 11 are preferably made of the kinds of porous expanded PTFE described above, in that PTFE has a very high hydrophobicity and can be made adequately porous to pass large volumes of air while at the same time maintaining a very high water entry pressure as described above in the referenced patents. Other porous polymers of different materials, such as porous polypropylene can be used in the invention as long as the combination of hydrophobicity and pore size allows adequate oxygen passage and water resistance for use in diving equipment at diving depths at which the equipment is used.

The present invention has the primary advantage that oxygen dissolved in the water can be inhaled via the walls of the multiplicity of tubes even when the snorkel is completely submerged beneath the surface of the water. Accidents occuring in the case of conventional snorkels can thus be prevented and continuous diving can be performed for a long period of time.

It will be obvious to those skilled in the art that many changes and variations in both materials and methods could be used, but it is intended that the scope of the invention is delineated only in the appended claims.

I claim:

1. A snorkel comprising:

(a) a mouthpiece portion, including a check valve;

(b) a breathing tube extending outwardly from said mouthpiece portion; and (c) capping the outward end of said breathing tube a multiplicity of porous tubes which are impermeable to water but permeable to gases, said tubes being sealed at one end and gathered together at the other end of each tube to form an integral unit, said unit being inserted in or affixed to said breathing tube in an airtight manner.

2. The snorkel of claim 1 in which said porous tubes comprise porous polymer having a combination of hydrophobicity and pore size to exclude water at hydrostatic pressures usable by human divers.

3. The snorkel of claim 2, wherein said porous tubes comprise porous polytetrafluoroethylene, polypropylene, or polyhalogenated hydrocarbon polymers.

4. The snorkel of claim 3, wherein said porous tubes comprise porous expanded polytetrafluoroethylene.

5. The snorkel of claim 1, wherein said porous tubes are bonded together at the open end thereof by a heat-sealing process.

6. The snorkel of claim 1, wherein said porous tubes are bonded together at the open end thereof by an adhesive.

* * * * *